United States Patent [19]

Deutsch

[11] Patent Number: 4,464,965

[45] Date of Patent: Aug. 14, 1984

[54] AUTOCORRELATION TONE GENERATOR FOR AN ELECTRONIC MUSICAL INSTRUMENT

[75] Inventor: Ralph Deutsch, Sherman Oaks, Calif.

[73] Assignee: Kawai Musical Instrument MFG. Co., Ltd., Hamamatsu, Japan

[21] Appl. No.: 441,014

[22] Filed: Nov. 12, 1982

[51] Int. Cl.[3] ..... G10H 7/00

[52] U.S. Cl. ..... 84/1.01; 84/1.22

[58] Field of Search ..... 84/1.01, 1.03, 1.19–1.23

[56] References Cited

U.S. PATENT DOCUMENTS 4,282,786 8/1981 Deutsch et al. ..... 84/1.01

4,398,442 8/1983 Deutsch ..... 84/1.01 X

*Primary Examiner*—Stanley J. Witkowski

*Attorney, Agent, or Firm*—Ralph Deutsch

[57] ABSTRACT

A keyboard operated electronic musical instrument having a number of tone generators which are assigned to actuated keyswitches. A tone selection means is implemented comprising an autocorrelation function generator. A set of harmonic coefficients is created by means of a discrete Fourier-cosine transformation of the autocorrelation function. A computing means transforms the harmonic coefficients to musical tones. The generated musical tones are varied in tone color by selecting the shape of the autocorrelation function. A means is provided to vary the autocorrelation function in a time variant manner in response to a control signal.

14 Claims, 5 Drawing Figures

AUTOCORRELATION TONE GENERATOR FOR AN ELECTRONIC MUSICAL INSTRUMENT

BACKGROUND OF THE INVENTION

1. Field of the Invention

This invention relates to electronic musical tone synthesis and in particular is concerned with the generation of tones corresponding to selected autocorrelation functions.

2. Description of the Prior Art

The current trend toward digital tone generations systems is primarily motivated by the quest for a commercially viable musical instrument which can produce good tone characteristics and which can be implemented at a commercially acceptable cost. The prior art in digital tone generators can be broadly distinguished into three generator classes.

The first generator class is one in which the tone generation system depends upon a stored library of musical waveshapes. Each stored waveshape corresponds to a tone control, or stop, located on the console of the musical instrument. The stored waveshapes are read out of memory at an address advance rate of $f=NF$ where N is the number of data points per period of the waveshape and F is the fundamental pitch of the generated musical tone. A tone generator of the first generator class is described in U.S. Pat. No. 3,515,792 entitled "Digital Organ."

A second generator class is one that is called by the generic name of "harmonic synthesis." Tone generators of the second generator class are operated by implementing a discrete Fourier transform to compute points for a musical waveshape using a stored library of harmonic coefficients. Subsets of the stored harmonic coefficients are selected by actuating tone control switches. Tone generators belonging to the second generator class are described in U.S. Pat. No 3,809,786 entitled "Computor Organ" and in U.S. Pat. No. 4,085,644 entitled "Polyphonic Tone Synthesizer."

A third generator class is one in which a number of harmonic components are obtained by frequency modulating a sinusoid function at the fundamental frequency of the generated musical tone. Various tones are obtained by selection of the modulation indices as well as by varying the frequency and waveshape of the frequency modulating signal. A tone generator of the third generator class is described in U.S. Pat. No. 4,175,464 entitled "Musical Tone Generator With Time Variant Overtones."

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created. Each computation cycle comprises a correlation transform cycle followed by a coefficient transform cycle. During a correlation transform cycle a preselected autocorrelation function is converted to a set of harmonic coefficients. During a coefficient transform cycle the set of harmonic coefficients are converted to form the data words comprising a master data set. At the end of each computation cycle, the computed master data set is stored in a main register.

Variations in the generated musical tone are obtained by selections from a set of autocorrelation functions and by changing the autocorrelation function by means of nonlinear transformations which may be time variant. The computations during a computation cycle are implemented at a fast rate which may be nonsynchronous with any musical frequency.

Following each computation cycle, a transfer cycle is initiated during which the stored master data set is transferred from the main register to preselected members of a multiplicity of tone generators and stored in a note register which is an element of each of the individual tone generators. The output tone generation continues uninterrupted during the computation and transfer cycles.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a tone generator in which musical tones are generated by computing a waveshape corresponding to a selected autocorrelation function. The tone generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all the elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer or correspond to combinations of several elements appearing in the referenced patent.

Figure 1:
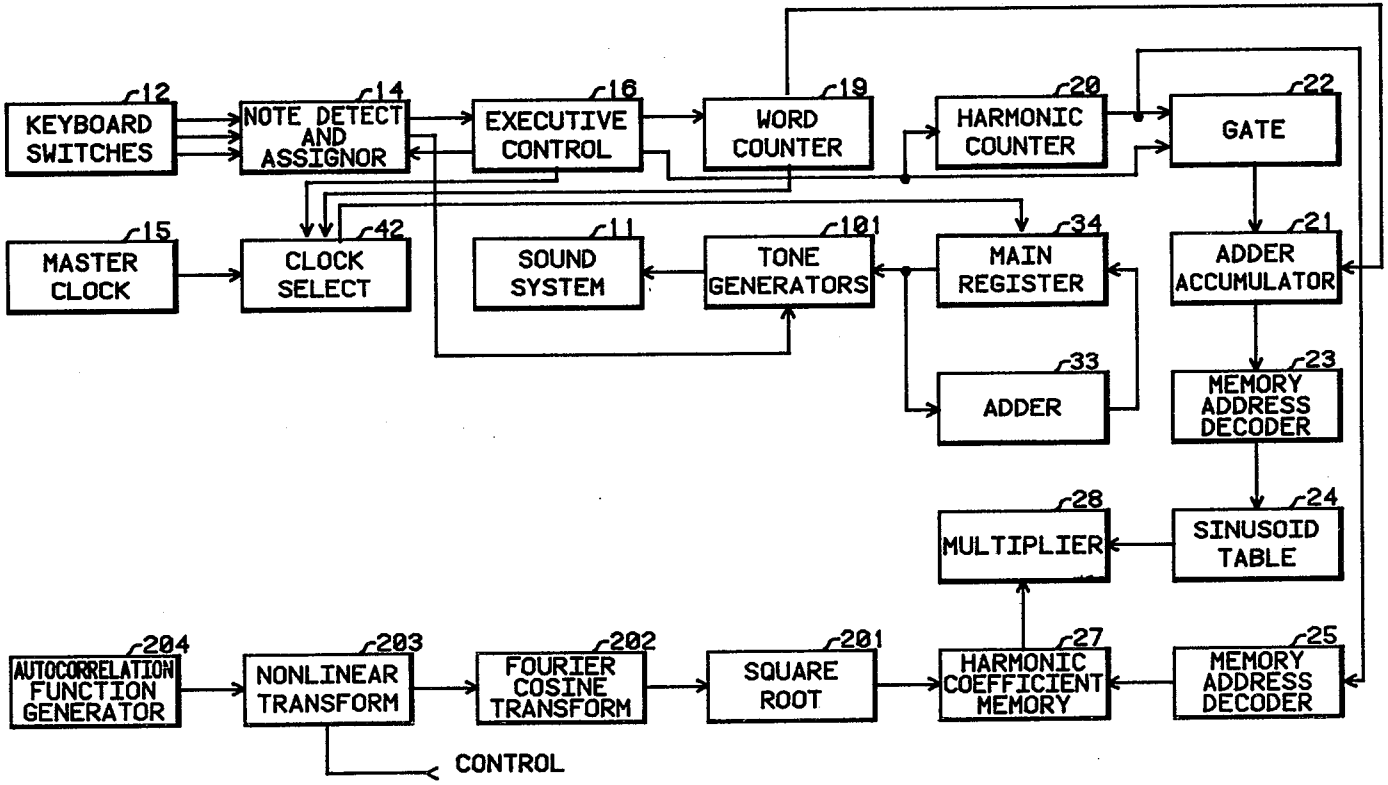
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard switches. The array is contained in the system block labeled keyboard switches 12. If one or more of the keyboard switches have a switch status change and are actuated ("on" position) on the instrument's keyboard, the note detect and assignor 14 stores the corresponding note information for the actuated keyswitches and one member of the set of tone generators 101 is assigned to each actuated keyswitch. A suitable note detect and assignor subsystem is described in U.S. Pat. No. 4,022,098 which is hereby incorporated by reference.

When one or more keyswitches on the keyboards have been actuated, the executive control 16 initiates a sequence of computation cycles. Each computation cycle comprises a correlation transform cycle followed by a coefficient transform cycle. During each coefficient transform cycle, a master data set consisting of 64 data words is computed in a manner described below and stored in the main register 34. The 64 data words in the master data set are generated using the 32 harmonic coefficients stored in the harmonic coefficient memory 27. The 64 data words in the master data set correspond to the amplitudes of 64 equally spaced points of one cycle of the audio waveform for the musical tone produced by the tone generators 101. The general rule is that the maximum number of harmonics in the audio tone spectra is no more than one half of the number of data points in one complete waveshape period. Therefore, a master data set comprising 64 data words corresponds to a maximum of 32 harmonics.

At the completion of each coefficient transform cycle in the sequence of computation cycles, a transfer cycle is initiated during which the master data set residing in the main register 34 is transferred to note registers which are elements of each member of the set of tone generators contained in the system block labeled tone generators 101. These note registers store the 64 data words comprising the master data set. The data words stored in the note registers are read out sequentially and repetitively and transferred to a digital-to-analog converter which converts the digital data words into an analog musical waveshape. The digital-to-analog converter is contained in the system block labeled sound system 11. The musical waveshape is tranformed into an audible sound by means of a sound system consisting of a conventional amplifier and speaker subsystem which are also contained in the system block labeled sound system 11. The stored data is read out of each note register at an address advance rate corresponding to the fundamental frequency of the note corresponding to the actuated keyswitch to which a tone generator has been assigned.

As described in the referenced U.S. Pat. No. 4,085,644 it is desirable to be able to continuously recompute and store the generated master data set during a sequence of computation cycles and to load this data into the note registers while the actuated keys remain depressed on the keyboards. This system function is accomplished without interrupting the flow of data points to the digital-to-analog converter at the read-out clock rates.

In the manner described in the referenced U.S. Pat. No. 4,085,644 the harmonic counter 20 is initialized at the start of each coefficient transform cycle. Each time that the word counter 19 is incremented so that it returns to its initial state because of its modulo counting implementation a signal is provided which increments the count state of the harmonic counter 20. The word counter 19 is implemented to count modulo 64 which is the number of data words in the master data set which is generated and stored in the main register 34. The harmonic counter 20 is implemented to count modulo 32. This number corresponds to the maximum number of harmonics consistent with a master data set comprising 64 data words.

At the start of each coefficient transform cycle, the contents of the accumulator contained in the adder-accumulator 21 is initialized to a zero value. Each time that word counter 19 is reset to its initial value, the accumulator is reset to a zero value. Each time that the word counter 19 is incremented, the accumulator adds the current count state of the harmonic counter 20 to the sum contained in the accumulator.

The content of the accumulator in the adder-accumulator 21 is used by the memory address decoder 23 to address out trigonometric sinusoid values from the sinusoid table 24. The sinusoid table is implemented as a read only memory storing values of the trigonometric function sin $(2\pi\phi/32)$ for $0 \leqq \phi \leqq 32$ at intervals of D. D is a table resolution constant.

The trigonometric values read out from the sinusoid table 24 are provided as one of the input data values to the multiplier 28.

The harmonic coefficient memory 27 contains a set of harmonic coefficient values which are computed in a manner described below. The memory address decoder 25 addresses out selected harmonic coefficient values in response to the count state of the harmonic counter 20.

The multiplier 28 is used to multiply the trigonometric value read out from the sinusoid table by the harmonic coefficient value read out from the harmonic coefficient memory 27. The product formed is furnished as one input to the adder 33.

The contents of the main register 34 are initialized to a zero value at the start of a coefficient transform cycle. Each time that the word counter 19 is incremented, the contents of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 32 complete count cycles of 64 counts, the main register 34 will contain the master data set corresponding to the selected musical tone.

The harmonic coefficient values which are stored in the harmonic coefficient memory 27 are evaluated by transforming an autocorrelation function which is furnished by the autocorrelation function generator 204. The system utilizes the well-known property that the autocorrelation function for a real-valued time series, or waveshape, is a real-valued even function. In addition, the Fourier-cosine transform of the autocorrelation function is the power-density function of the waveshape corresponding to the autocorrelation function. Finally, the positive square root of the elements of the power-density function are the harmonic coefficients corresponding to the spectra of the waveshape.

The relations between a waveshape and its autocorrelation function is due to Norbert Wiener as presented in his classical work on stationary time series. He took a radically different point of view in investigating the structure of time series or waveshapes. Instead of the previous limited approach of relating waveshapes and harmonic coefficients in the then well-established Fourier analysis techniques, he concentrated on the relations between a waveshape and its autocorrelation function.

Since the autocorrelation function can be considered as a "time" function in a broad generic sense, an interesting and novel feature is that a "time" function can be used to generate a musical waveshape which is a function of real time.

Figure 2:
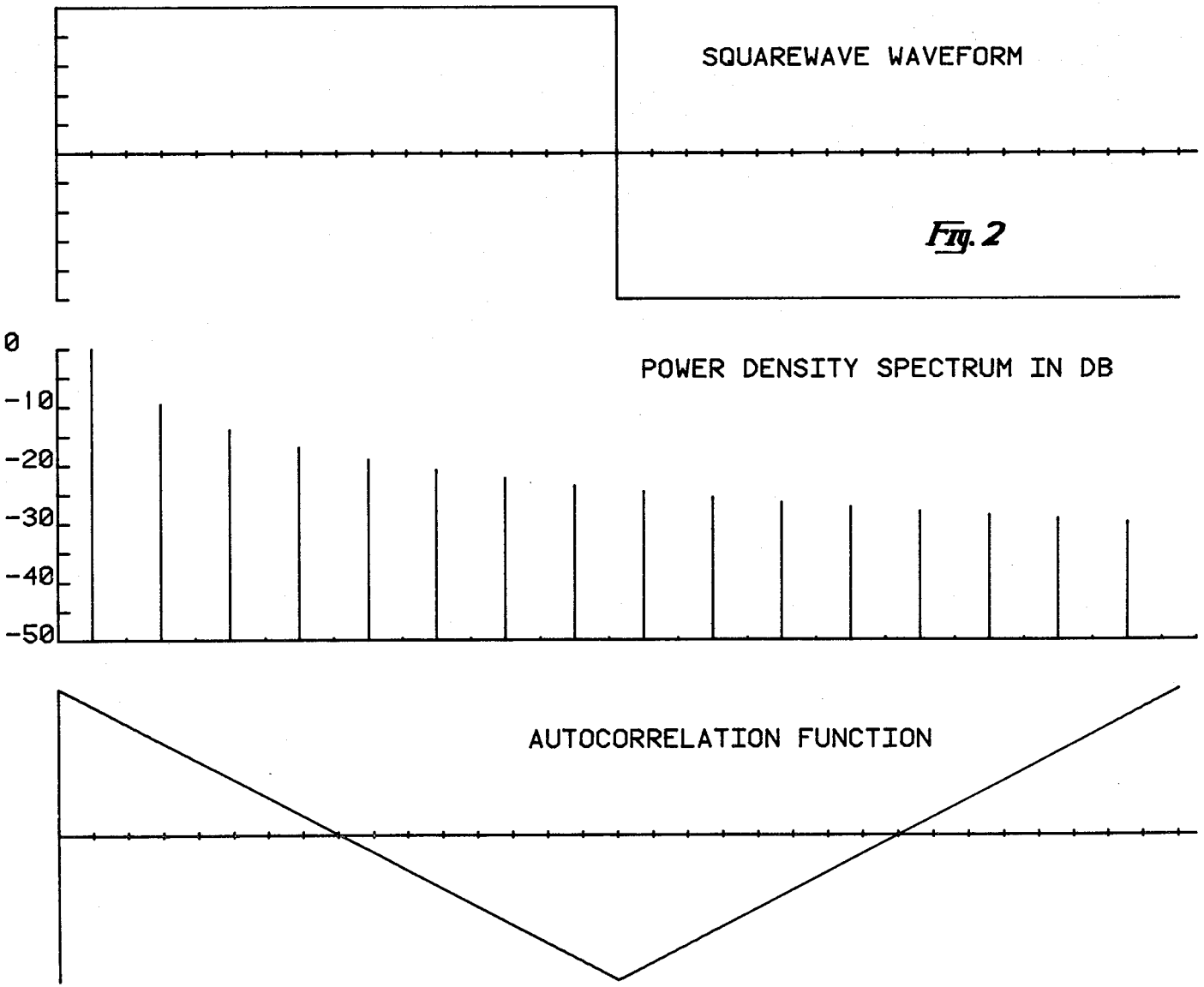
FIG. 2 is a graph of the autocorrelation function for a square wave.

The relation between the waveshape, power spectrum, and the autocorrelation function for a square wave is shown in FIG. 2. The power spectrum has the well-known shape and only contains odd numbered harmonics. The autocorrelation function has a triangular shape having a maximum value at a zero correlation spacing and is even-symmetric with respect to the maximum value.

The function of the nonlinear transform 203 is to distort the autocorrelation function produced by the autocorrelation function generator 204. The distortion is determined by the CONTROL signal which may be either a constant value or may be varied in a time dependent manner.

The Fourier-cosine transform 202 calculates the Fourier-cosine transform of the data furnished by the nonlinear transform 203. The square root 201 performs a positive square root operation on the data furnished by the Fourier-cosine transform 202 and the result of this operation is stored in the harmonic coefficient memory 27.

Figure 3:
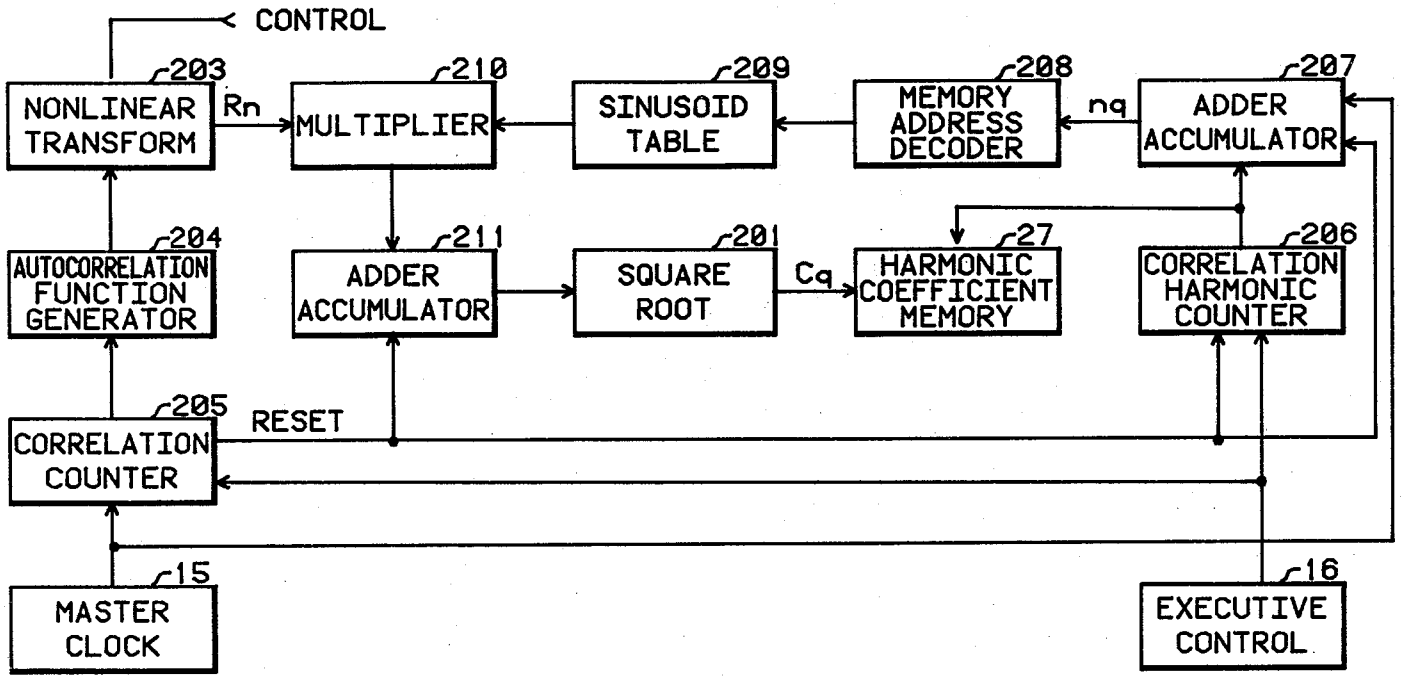
FIG. 3 is a schematic diagram of the autocorrelation transform subsystem.

The details of the transform operation starting with the autocorrelation function are shown in FIG. 3.

The timing signals furnished by the master clock 16 are used to increment the correlation counter 205. The correlation counter 205 is implemented to count modulo 64. Each time that the correlation counter 205 returns to its minimal, or zero value, count state because of its modulo counting implementation a RESET signal is generated. The count states of the correlation counter 205 are used by the autocorrelation function generator 204 to create an autocorrelation function.

The correlation harmonic counter 206 is incremented by the RESET signal generated by the correlation counter 205. The correlation harmonic counter 206 is implemented to count modulo 32. At the start of the correlation tranform cycle which is the first segment of each computation cycle, both the correlation counter 205 and the correlation harmonic counter 206 are simultaneously initiated to their initial, or zero, count state in response to a signal furnished by the executive control 16.

In response to each time signal provided by the master clock 16, the adder-accumulator 207 adds the count state of the correlation harmonic counter 206 to the contents of an accumulator. The accumulator is reset to a zero value in response to the RESET signal generated by the correlation counter 205.

The memory address decoder 208 accesses a trigonometric cosine value from the sinusoid table 209 in response to the number contained in the accumulator within the adder-accumulator 207. The sinusoid table stores values of the trigonometric function cos $(2\pi nq/64)$ for values of $nq=1,2,\ldots,64$.

The trigonometric value read out from the sinusoid table 207 is multiplied by the data output $R_n$ from the nonlinear transform 203 by means of the multiplier 210.

The successive products furnished by the multiplier 210 are added to the contents of an accumulator in the adder-accumulator 211. In response to the RESET signal generated by the correlation counter 205, the content of the accumulator is transferred to the square root 201 and then the accumulator is reset to an initial zero value. The net result is that the input data value to the square root 201 is the power spectral value $c_q^2$, where $$c_q^2 = \sum_{n=1}^{64} R_n \cos(2\pi nq/64) \qquad \text{Eq. 1}$$

The positive square root value $c_q$ is the desired q harmonic coefficient. This value is stored in the harmonic coefficient memory 27 at a memory location corresponding to the count state of the correlation harmonic counter 17.

The musical waveshape produced by the described system is determined by the selected shape of the autocorrelation function. There is an almost limitless variety of autocorrelation functions. These functions are only limited in that they must be an even function about the maximum value.

Figure 4:
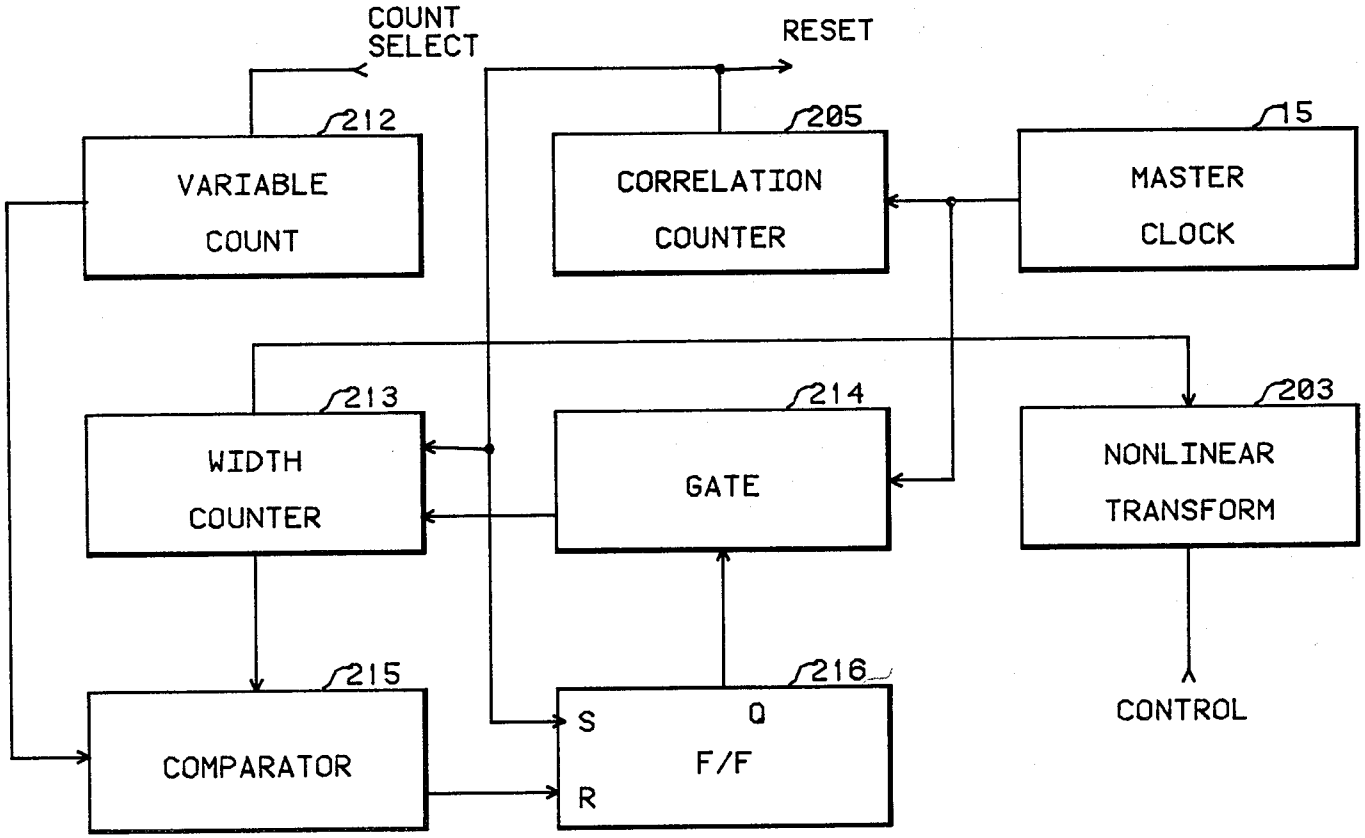
FIG. 4 is a schematic diagram of an autocorrelation function generator.

FIG. 4 illustrates the logic for an autocorrelation function generator 204 implemented to generate a pulse-shaped autocorrelation function. The width of the function is determined by a binary number inserted into the variable count 213 by means of the COUNT SELECT signal line. The flip-flop 216 is set in response to the RESET signal generated by the correlation counter 205. When the flip-flop 32 is set, timing pulses produced by the master clock 16 are transferred via gate 214 to increment the count states of the width counter 213. When comparator 215 finds that the count state of the width counter 213 is equal to the control number stored in the variable count 212, a signal is generated by the comparator 215 which resets the flip-flop 216. The RESET signal from the correlation counter 205 is used to initialize the count state of the width counter 213 to its maximum count state corresponding to a decimal value 63. The width counter 213 is implemented as a count-down counter whose count states are decremented by the input timing signals transferred by the gate 214.

The nonlinear transform 203 can be implemented as a symmetrical limiter. Thus only signals less in absolute value than a presassigned signal level will be transferred unaltered by this device. If the input signal has an absolute magnitude equal to or greater than the preassigned signal level, they will be altered to have the magnitude of the preassigned signal level but will retain their original algebraic sign. The preassigned signal level is introduced by means of the CONTROL signal. The CONTROL signal can be made time variant to produce synthesizer-like tones in which the tone color varies with time in a controlled fashion.

The preceding description indicated that each computation cycle in a repetitive sequence of computation cycles comprised two subcomputation cycles. The first subcomputation cycle comprises a correlation transform cycle during which an autocorrelation function is generated and the transformed to produce a set of harmonic coefficients. The second subcomputation cycle comprises a coefficient transform cycle during which a master data set is generated using the harmonic coefficients that were created during the prior correlation transform cycle.

The system can readily operate in an alternate fashion in which the computation cycle consists only of the coefficient transform cycle. The generation of the harmonic coefficients from preselected autocorrelation functions can be almost completely independent from the calculation of the master data set. The only timing restriction is that a data latch is required on the output of the square root 201 so that data cannot be written into the harmonic coefficient memory 27 at a time when data must be read out of this memory. The data latch serves to hold the new data until a time is available to write it into the harmonic coefficient memory.

The CONTROL signal input to the nonlinear transform 203 can advantageously be an ADSR envelope function which is similar to the ADSR envelope function applied to the assigned tone generators. A suitable ADSR envelope generator is described in U.S. Pat. No. 4,079,650 entitled "ADSR Generator." This patent is hereby incorporated by reference.

The present invention can be incorporated into a variety of tone generators which operate by employing a discrete Fourier-type transform to compute waveshape points from selected sets of harmonic coefficients. One such tone generator system is described in U.S. Pat. No. 3,809,789 entitled "Computor Organ." This patent is hereby incorporated by reference.

Figure 5:
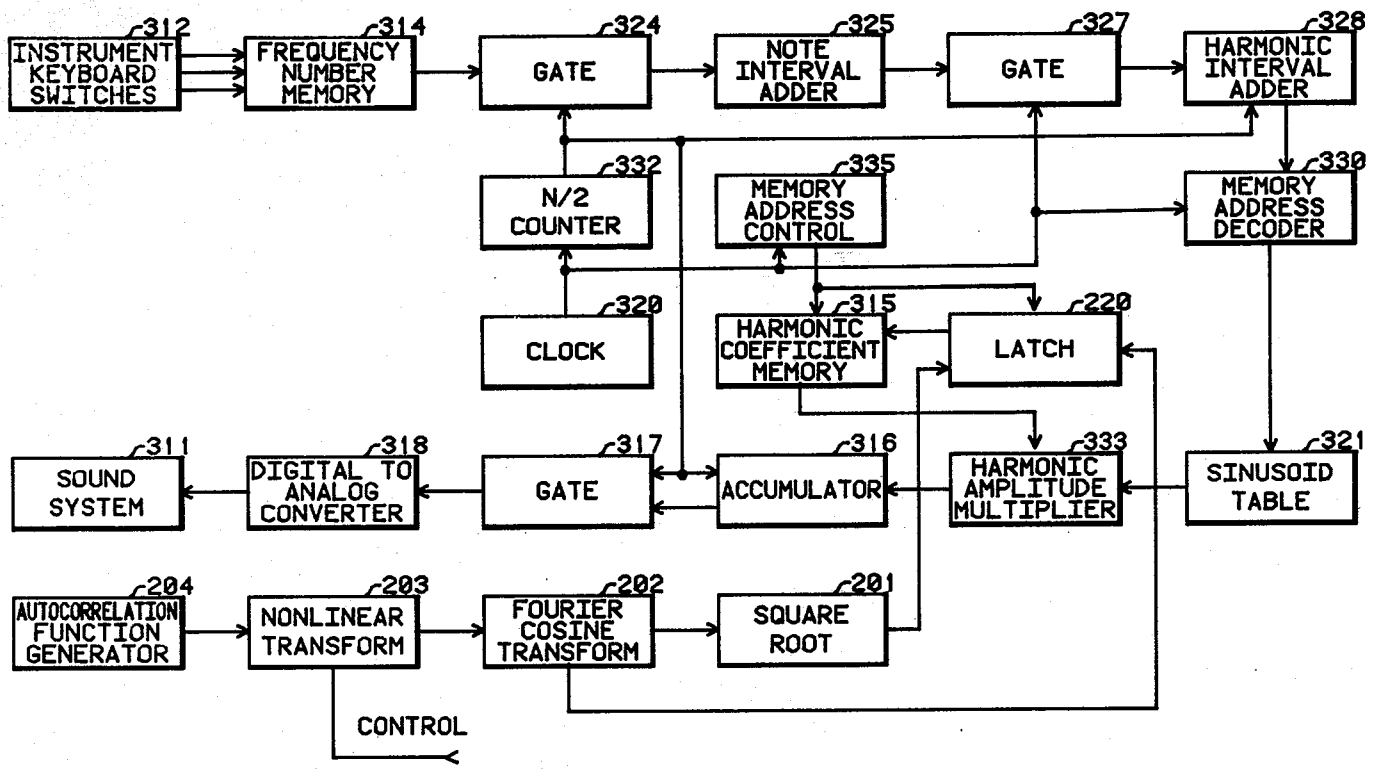
FIG. 5 is a schematic diagram of an alternate embodiment of the invention.

FIG. 5 illustrates a tone generator system which incorporates the present invention into the Computor Organ described in the referenced patent. The system blocks shown in FIG. 5 are numbered to be 300 plus the corresponding block numbers shown in FIG. 1 of the referenced patent.

A closure of a keyswitch contained in the instrument keyboard switches 312 causes a corresponding frequency number to be accessed out from the frequency number memory 314. The accessed frequency number is added repetitively to the contents of the note interval adder 325. The contents of the note interval adder 325 specifies the sample point at which a waveshape amplitude is calculated. For each sample point, the amplitudes of a number of harmonic components are calculated individually by multiplying harmonic coefficients read out of the harmonic coefficient memory 315 by a trigonometric sinusoid value read out from the sinusoid table 321 by the memory address decoder 330. The harmonic component amplitudes are summed algebraically in the accumulator 316 to obtain the net amplitude at a sample point. The sample point amplitudes are converted into an analog signal by means of the digital-to-analog converter 318.

The operation of the system blocks 204,203,202 and 201 has been described previously and operate in the same fashion with respect to the Computor Organ tone generating system. The output data values produced by the square root 201 are stored temporarily in the latch 220. The stored data value in the latch 220 is written into the harmonic coefficient memory 315 at a time at which data is not accessed from the harmonic coefficient memory. The data address for the new harmonic coefficient memory is furnished by the count state of the correlation harmonic counter 206 which is a component of the Fourier cosine transform 202 (FIG. 3).

I claim:

1. In a musical instrument in which a plurality of data words corresponding to the amplitudes of points defining the waveform of a musical tone are computed and converted into musical tones, apparatus for generating a musical tone corresponding to a selected autocorrelation function comprising;

an autocorrelation function generator wherein a selected autocorrelation function is generated comprising a sequence of autocorrelation data words, a cosine transform means responsive to said sequence of autocorrelation data words wherein a set of harmonic coefficients of number N are generated, a means for computing, responsive to said set of harmonic coefficient values, whereby said plurality of data words corresponding to the amplitudes of points defining the waveform of a musical tone are computed, and a means for producing a musical tone from said plurality of data words thereby generating said musical tone corresponding to a selected autocorrelation function.

2. A musical instrument according to claim 1 wherein said means for computing comprises a clock for providing timing signals.

3. A musical instrument according to claim 2 wherein said autocorrelation function generator comprises;

a correlation counter for counting said timing signals modulo two times said number N and wherein a reset signal is generated when said correlation counter is reset to its minimal count state, and a number generating means responsive to the contents of said correlation counter wherein said sequence of autocorrelation data words are generated having a maximum value when said reset signal is generated and whereby said sequence of autocorrelation data words are generated with values which are even-symmetric with respect to said maximum value.

4. A musical instrument according to claim 3 wherein said cosine transform means comprises;

a correlation harmonic counter incremented by said reset signal, a first adder-accumulator means wherein the count state of said correlation harmonic counter is successively added to the contents of an accumulator in response to said timing signals, a first sinusoid table for storing a plurality of trigonometric cosine values, a first address decoder means responsive to the content of said accumulator in said first adder-accumulator means for reading out trigonometric sinusoid values from said first sinusoid table, a first multiplier means for multiplying the trigonometric sinusoid values read out from said first sinusoid table by said sequence of autocorrelation data words to form a sequence of product values, a summing means for summing said sequence of product values to form a power density value, and a square root means responsive to said power density value wherein a harmonic coefficient is generated corresponding to the positive square root of said power density value.

5. A musical instrument according to claim 4 wherein said cosine transform means further comprises;

a coefficient memory means, and a second address decoder means responsive to the count state of said correlation harmonic counter whereby said harmonic coefficient is stored in said coefficient memory means.

6. A musical instrument according to claim 3 wherein said autocorrelation function generator further comprises;

a nonlinear means whereby said sequence of autocorrelation data words are altered in value in response to a control signal to form a modified sequence of autocorrelation data words which are provided to said cosine transform means.

7. A musical instrument according to claim 6 wherein said nonlinear means comprises;

a limiting means wherein if the absolute magnitude of the value of one of said sequence of autocorrelation data words is less than or equal to said control signal it is transferred unaltered to form a corresponding one of said modified sequence of autocorrelation data words and wherein if the absolute magnitude of the value of one of said sequence of autocorrelation data words is greater than said control signal it is altered to a value equal to said control signal having an algebraic sign identical to its original algebraic sign and whereby said altered value forms a corresponding one of said modified sequence of autocorrelation data words.

8. A musical instrument according to claim 2 wherein said means for computing further comprises;

a main memory means for storing said plurality of data words computed during each computation cycle in a repetitive sequence of computation cycles, a word counter for counting said timing signals modulo the number of said plurality of data words stored in said main memory means, a harmonic counter incremented each time said word counter returns to its minimal count state, an adder-accumulator means wherein the count state of said harmonic counter is successively added to the contents of an accumulator in response to said timing signals and wherein the content of said accumulator is initialized to a zero value at the start of each computation cycle, a sinusoid table for storing a plurality of trigonometric sinusoid values, an address decoder means responsive to the content of said accumulator in said second adder-accumulator means for reading out trigonometric sinusoid values from said second sinusoid table, a multiplier means for multiplying the trigonometric sinusoid values read out from said second sinusoid table by said set of harmonic coefficient values, and a means for successively summing the output from said second multiplier means with values read out of said main memory means in response to the count state of said word counter and whereby the summed values are stored in said main memory means.

9. In a musical instrument in which a plurality of data words are computed at regular time intervals and converted into musical tones, apparatus for generating a musical tone corresponding to a selected autocorrelation function comprising;

an autocorrelation function generator wherein a selected autocorrelation function is generated comprising a sequence of autocorrelation data words, a cosine transform means responsive to said sequence of autocorrelation data words wherein a set of harmonic coefficients of number N are generated, a means for computing, responsive to said set of harmonic coefficients, for computing at regular time intervals a sequence of data words each of which corresponds to a combination of a number of tone generators, and a means for producing musical tones from said sequence of data words thereby generating said musical tone corresponding to a selected autocorrelation.

10. A musical instrument according to claim 9 wherein said autocorrelation function generator comprises;

a clock for providing timing signals, a correlation counter for counting said timing signal modulo two times said number N and wherein a reset signal is generated when said correlation counter is reset to its minimal count state, and a number generating means responsive to the contents of said correlation counter wherein said sequence of autocorrelation data words are generated having a maximum value when said reset signal is generated and whereby said sequence of autocorrelation data words are generated with values which are even-symmetric with respect to said maximum value.

11. A musical instrument according to claim 10 wherein said cosine transform means comprises;

a correlation harmonic counter incremented by said reset signal, a first adder-accumulator means wherein the count state of said correlation harmonic counter is successively added to the contents of an accumulator in response to said timing signals, a first sinusoid table for storing a plurality of trigonometric cosine values, a first address decoder means responsive to the content of said accumulator in said first adder-accumulator means for reading out trigonometric sinusoid values from said first sinusoid table, a first multiplier means for multiplying the trigonometric sinusoid values read out from said first sinusoid table by said sequence of autocorrelation words to form a sequence of product values, a summing means for summing said sequence of product values to form a power density value, a square root means responsive to said power density value wherein a harmonic coefficient is generated, a coefficient memory means, and a second address decoder means responsive to said correlation harmonic counter whereby said correlation coefficient is stored to be thereafter written into said coefficient memory means.

12. A musical instrument according to claim 10 wherein said autocorrelation function generator further comprises;

a nonlinear means whereby said sequence of autocorrelation data words are altered in value in response to a control signal to form a modified sequence of autocorrelation data words which are provided to said cosine transform means.

13. A musical instrument according to claim 9 wherein said means for computing comprises;

a means for obtaining a frequency number, a note interval adder wherein said frequency number is successively added to the sum previously contained in said note interval adder, a harmonic interval adder cleared before each computation of one of said sequence of data words wherein the content of said note interval adder is added to the contents previously in said harmonic interval adder, a sinusoid table for storing a plurality of trigonometric sinusoid values, an address decoder means responsive to the contents of said harmonic interval adder for reading out trigonometric sinusoid values from said second sinusoid table, a multiplier means for multiplying the trigonometric sinusoid values read out from said second sinusoid table by said generated set of harmonic coefficients, and a means for successively summing the output from said second multiplier means thereby creating said sequence of data words each of which corresponds to a combination of a number of tone generators.

14. In a musical instrument apparatus for producing musical tone comprising;

an autocorrelation function generator for generating an autocorrelation function a first computing means responsive to said autocorrelation function for creating a set of harmonic coefficients, a second computing means responsive to said set of harmonic coefficients for generating a sequence of data values corresponding to said musical tones, and a means for producing musical tones from said sequence of data values.

* * * * *